US007086619B2

(12) United States Patent
Hefle et al.

(10) Patent No.: US 7,086,619 B2
(45) Date of Patent: Aug. 8, 2006

(54) METHOD AND DEVICE FOR COMMINUTING PARTICLES

(75) Inventors: Gustav Hefle, Aalen (DE); Roland Schüssler, Schlierbach (DE); Hans-Peter Feuerpeil, Strassdorf (DE); Dieter Bläse, Mutlangen (DE)

(73) Assignee: Pulsar GmbH, Aalen-Essingen (DE)

( * ) Notice: Subject to any disclaimer, the term of this patent is extended or adjusted under 35 U.S.C. 154(b) by 0 days.

(21) Appl. No.: 11/267,246

(22) Filed: Nov. 7, 2005

(65) Prior Publication Data

US 2006/0054723 A1 Mar. 16, 2006

Related U.S. Application Data

(62) Division of application No. 10/380,348, filed as application No. PCT/EP01/10119 on Sep. 3, 2001.

(51) Int. Cl.
*B02C 19/00* (2006.01)

(52) U.S. Cl. ..... 241/40; 241/1; 241/5; 241/39

(58) Field of Classification Search ..... 241/1, 241/5, 39, 40

See application file for complete search history.

(56) References Cited

U.S. PATENT DOCUMENTS 2,665,850 A * 1/1954 Wiczer ..... 528/481
2,945,633 A * 7/1960 Lykken et al. ..... 241/41
3,897,010 A * 7/1975 Weishaupt et al. ..... 241/5
5,368,735 A * 11/1994 Ford ..... 210/512.1
5,447,275 A 9/1995 Goka et al.
5,839,670 A 11/1998 Omata et al.
5,921,481 A 7/1999 Nakamura et al.
5,934,575 A * 8/1999 Ohnishi et al. ..... 241/5

FOREIGN PATENT DOCUMENTS

SU 417165 11/1974
SU 457486 * 1/1975

OTHER PUBLICATIONS

Derwent Publications Ltd., London, GB: Class J02, AN 1975-81014W; XP002187410, Mar. 20,1975.

* cited by examiner

*Primary Examiner*—Derris H. Banks
*Assistant Examiner*—Jason Y Pahng
(74) *Attorney, Agent, or Firm*—Venable LLP; Robert Kinberg; Jeffrey W. Gluck

(57) ABSTRACT

The invention relates to a process and an apparatus for comminuting particles. The apparatus comprises at least one tube for collecting a given amount of particles, the particles forming a plug inside the tube. The apparatus further comprises at least one pressure pulse unit for generating pressure pulses, in which context the plug, subjected to a pressure pulse, is propelled from an exit aperture of the tube to hit a baffle located downstream of the tube and comprising apertures. Finally, the apparatus comprises a collection chamber following on to the baffle, in which the particles, comminuted by the impact against the baffle and passing through the apertures, are collected.

21 Claims, 2 Drawing Sheets

METHOD AND DEVICE FOR COMMINUTING PARTICLES

CROSS-REFERENCE TO RELATED APPLICATIONS

This application is a divisional application of co-pending U.S. patent application Ser. No. 10/380,348, filed Jul. 15, 2003, which is the national phase application of PCT/EP01/10119, filed on Sep. 3, 2001, which claims priority from German Patent Application No. 100 45 172.1, filed in Germany on Sep. 13, 2000, and German Patent Application No. 101 35 106.2, filed in Germany on Jul. 19, 2001, the contents of all of which are incorporated herein by reference in their entireties.

FIELD OF THE INVENTION

The invention relates to a process and apparatus for comminuting particles.

BACKGROUND OF THE INVENTION

An apparatus of this type is known from SU 457486. This apparatus comprises a tube extending vertically in a cylindrical chamber. The tube extends in the direction of the longitudinal axis of the chamber, sealed at the upper side by a baffle. The tube comprises an exit aperture at its upper side, located opposite the baffle in a preset spaced apart relationship. Below the baffle, the side wall of the chamber comprises apertures.

In the tube comminuted particles are collected forming a plug at a predetermined filling level inside the tube. The plug is accelerated explosively by way of a pressure pulse unit and is propelled from the tube against a baffle. When the particles hit the baffle, very high shearing forces occur resulting in a comminution of the particles. By the excess pressure generated in the pressure pulse unit finely comminuted particles are transported predominantly to the marginal regions of the chamber and discharged from the chamber via the apertures in the side walls. Coarser particles, on the other hand, drop back into the chamber and are returned to the pipe.

Even very hard particles may indeed be comminuted efficiently with this apparatus, which comprises virtually no moving parts and is thus of simple and cost-effective design. However, it suffers from the disadvantage that the particle sizes and particle size distributions of the comminuted particles can be preset and adjusted only inadequately.

In particular, it is disadvantageous that only an undesirable, incomplete and non-reproducible separation of fine and coarse particles comes about when the plug hits the baffle.

It is the object of the invention to make it possible to comminute preferably hard particles with as little constructional effort as possible, in which context the particle sizes of the comminuted particles may be preset as accurately as possible.

BRIEF SUMMARY OF THE INVENTION

The apparatus according to the invention comprises at least one tube for collecting a preset quantity of particles, the said particles forming a plug in the tube. Furthermore, the apparatus comprises at least one pressure pulse unit for generating pressure pulses, the plug being subjected to a pressure pulse and being propelled from and over an exit aperture of the tube to hit a baffle located downstream of the tube and comprising apertures. In addition, the apparatus comprises a collection chamber following on to the baffle, in which the particles, comminuted by the impact against the baffle and passing through the apertures, are collected.

Therefore, in order to comminute particles, located in a tube in the form of a plug, the basic concept of the invention resides in propelling this plug to hit a baffle with apertures.

The shearing forces exerted on the particles due to the impact, result in a comminution of the particles, in which case typically from the particles with an original particle size of 10 mm particles are obtained having sizes of one or a few μm.

By the excess pressure generated by the pressure pulse unit at the face of the baffle the particles having small particle sizes and therefore a low weight are transported through the apertures and reach the collection chamber. In contrast thereto, the heavy particles do not pass through the apertures and are preferably returned to the tube in order to form a new plug.

By appropriately selecting the diameter of the tube, the size and shape of the apertures of the baffle and/or the size of the collection chamber the particle sizes and particle size distributions of the particles collected in the collection chamber may be preset.

In a preferred embodiment the baffle is mounted in an interchangeable manner. Thus, the particle size distribution of the comminuted particles collected in the collection chamber may be varied by interchanging different baffles with different apertures.

In a further advantageous embodiment the volume of the collection chamber is adjustable in such a manner that as a result the particle size distribution of the comminuted particles collected in the collection chamber may be varied.

An essential advantage of the apparatus according to the invention resides in the fact that the dimensions of the apertures in the baffle are so dimensioned that the latter performs a screening function. This means that the comminuted particles transported through the apertures remain in the collection chamber and are not transported back to the tube through the apertures.

By the design according to the invention of the baffle and the collection chamber located downstream thereof, the comminuted particles having the desired particle sizes are thus collected in the collection chamber with a high degree of efficiency and are separated off heavier particles. Preferably, at least one withdrawal aperture is provided in the collection chamber via which the comminuted particles may be withdrawn from the collection chamber.

A further essential advantage of the apparatus according to the invention resides in the fact that it has virtually no moving parts and that the only part subjected to wear and tear is represented by the baffle, which is replaceable in a very simple manner. As a result, the apparatus is of compact, robust and maintenance-friendly construction, necessitating only low investment and maintenance costs. In addition, the comminution of the particles may be performed with low energy requirements so that the operation costs of the apparatus according to the invention are correspondingly low. Since the apparatus comprises virtually no moving parts and, in addition, preferably is of closed design, it presents no risk to the operating staff and is thus safe in terms of workers' protection regulations.

Finally, an essential advantage of the apparatus according to the invention is to be seen in that different materials, in particular also hard materials, may be comminuted efficiently and reliably without particular demands on the baffle, preferably made of steel.

The apparatus according to the invention is suited, in particular, for comminuting hard materials having Mohs' hardness scales in the range of 7 to 10. In particular, nitrides such as, for examples, TiN, ZrN, HfN, TaN and $BN_3$ may be comminuted with the apparatus according to the invention. Carbides such as, for example, TiC, ZrC, HfC, TaC, WC, $W_2C$ and $Ta_{0-8}$ $Hf_{0-2}$ C may likewise be comminuted. Furthermore, oxides such as $Al_2O_3$ as well as boride and silicide may be comminuted. The comminution of hard metals such as, for example, WC—Co having particle sizes of about 5 mm to particle sizes smaller than 10 μm is also possible; such particles could to date only be comminuted in wet milling processes.

Furthermore, the apparatus according to the invention may be used in the field of powder metallurgy, for example for vitrifying radioactive wastes, preparing nitrite in a nitrogen atmosphere or even for activating solid body reactions, in which context by way of the process according to the invention in particular silicon-carbide may be recovered directly from the elements.

Moreover, by way of the apparatus according to the invention even organic substances such as, for example, nut shells or bones, required for the preparation of gelatine, may be comminuted.

In the process even different particles may be collected in the tube in a particularly advantageous manner. These particles, propelled against the baffle are then not only comminuted. Rather, there also takes place a homogenous mixing of the different comminuted particles.

Finally, substances such as, for example, polymers, polyamides and rubber may also be comminuted, which are embrittled prior to comminution on the baffle. Embrittlement may be performed by using cryogenic gases in the pressure pulse unit, which are cooled to extremely low temperatures. Alternatively or in addition, the apparatus, in particular its comminution chamber, may be jacketed by a cooling jacket.

In a particularly advantageous embodiment of the invention, dry ice granules, i.e. frozen $CO_2$, are added to the soft particles to be comminuted to embrittle them, so that these may be comminuted by the apparatus according to the invention without further auxiliary expedients. Preferably, at least one aperture is provided in the apparatus for that purpose via which the dry ice granules are introduced into the interior, where the particles are collected.

Even when introducing the dry ice granules and the particles to be comminuted into the apparatus an efficient thorough mixing of both components takes place. Thorough mixing is furthermore promoted by the comminution processes within the apparatus, as during propelling of a plug against the baffle larger particles are returned from the baffle to that region, in which the dry ice granules and the particles to be comminuted are collected.

As a result, the particles to be comminuted are cooled directly and locally by the dry ice granules and are embrittled in the process. Cooling of the entire apparatus and of the material to be comminuted prior to feeding is not necessary for this purpose. Energy consumption as well as costs and construction expenditures for the embrittlement of the particles are correspondingly low.

An advantage of using dry ice granules resides in the fact that the latter, in comparison to liquid nitrogen, are cheaper to produce and easier to handle.

A further essential advantage of using dry ice granules resides in the fact that by using the latter not only an embrittlement of the particles to be comminuted is brought about, but also that the comminution process of the particles is promoted. This is based on the fact that dry ice granules are in the form of sharp-angled small crystals, having an abrasive effect, splitting and therefore comminuting other particles, in particular when propelling a plug to hit the baffle.

Depending on the material property of the particles to be comminuted, metering of the dry ice granules supply may be selected in an appropriate manner. This permits an easy adaptation of the cooling quantity required for the embrittlement of the particles.

A further advantage of using dry ice granules for the embrittlement of the particles is that the dry ice granules are to a large extent inert and do not react with the particles to be embrittled. In addition, the dry ice granules dissipate virtually without residue after heating as gaseous $CO_2$ and therefore leave behind no residues in the particles. In this context it is furthermore advantageous that due to the evaporation of the dry ice granules the collected particles are loosened up, thereby increasing their free flow properties. In general, the dry ice granules improve the rheological properties of the particles, i.e. their flowability, thereby promoting the processes in the apparatus.

By means of the apparatus according to the invention soft particles such as, for example, rubber, polymers and polyamides may be comminuted. In particular, polycaprolactam may be the polyamide comminuted. The comminution of polyvinylchloride is likewise possible.

BRIEF DESCRIPTION OF THE DRAWINGS

The invention is elucidated in what follows with reference to the drawings. There is shown in FIG. 1: a longitudinal section through a first embodiment of the apparatus according to the invention.

DETAILED DESCRIPTION OF THE INVENTION

Figure 1:
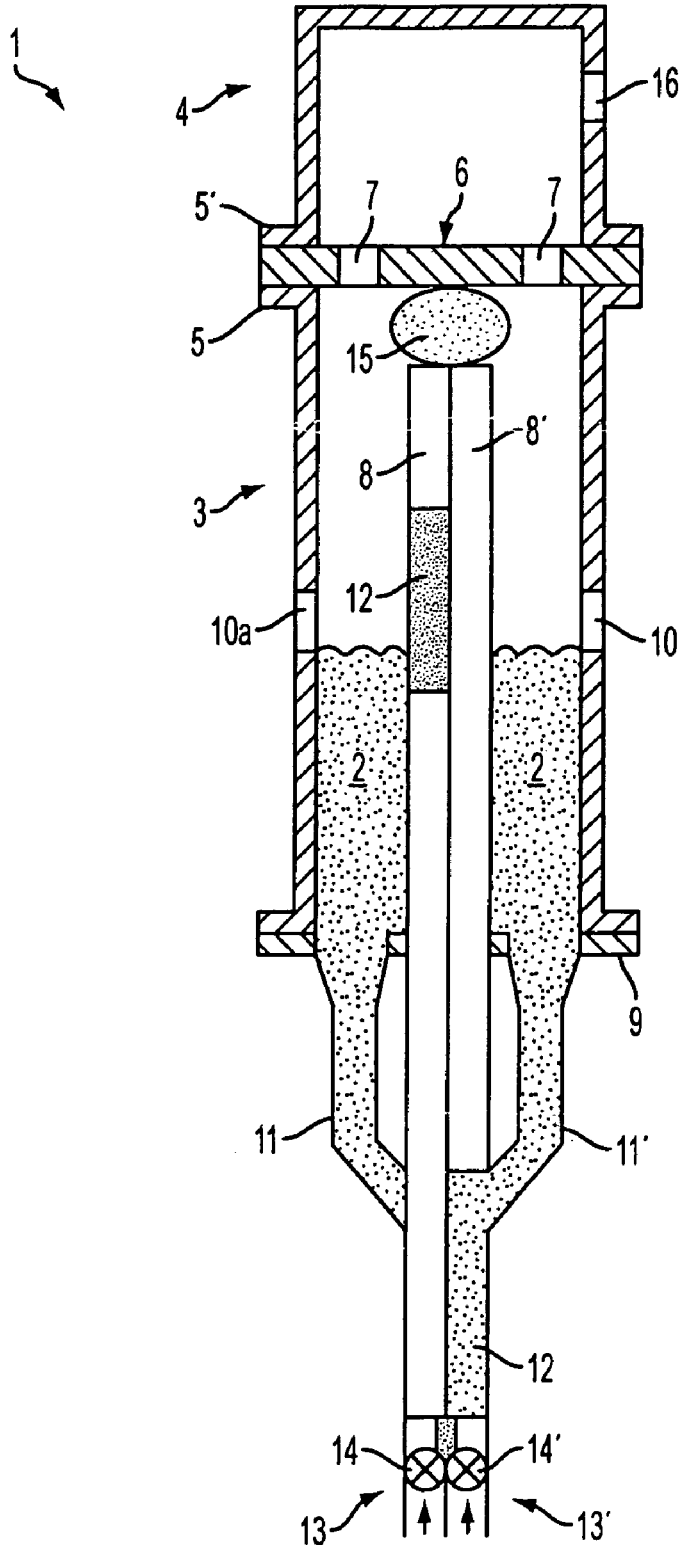

FIG. 1 shows a first embodiment of the apparatus 1 according to the invention for comminuting particles 2. The apparatus 1 comprises a hollow cylindrical comminution chamber 3 and a likewise hollow cylindrical collection chamber 4. The comminution chamber 3 and the collection chamber 4 have the same diameter and are arranged coaxially along a vertically extending axis of symmetry. In this context the collection chamber 4 with its open underside follows on to the likewise open upper side of the comminution chamber 3.

The comminution chamber 3 and the collection chamber 4 each comprise at their open ends, facing one another, an annular flange 5, 5'. Between the annular flanges 5, 5' a circular disc-like baffle 6, preferably made of steel, is mounted. The baffle 6 comprises a given number of apertures 7. In the present embodiment the apertures 7 are designed as round bores.

The baffle 6 may be fitted to the apparatus in a simple manner by way of the annular flanges 5, 5'. In particular, the baffle 6 may be exchanged without great mounting efforts and be replaced by other baffles 6, which may have different arrangements of apertures 7. The apertures 7 need in this context not be only in the form of round bores, but may also be designed as angular bores. A design of the apertures 7 in the form of annular slots or the like is also possible.

In the interior of the comminution chamber 3 two tubes 8, 8' extend parallel to the longitudinal axis of the comminution chamber 3. In principle, it is also possible to provide only one tube 8 or 8'. Furthermore, a larger number of tubes 8, 8' may likewise be provided.

The tubes 8, 8' extend to the centre of the comminution chamber 3 closely adjoining one another and exit at its bottom 9. At their upper ends the exit apertures of the tubes 8, 8' are spaced apart from opposite to the baffle 6 at a preset distance.

An aperture 10 is provided in the side wall of the comminution chamber 3. By way of this aperture 10, the interior of the comminution chamber 3 is charged with the particles to be comminuted up to a given filling level. A further aperture 10 a is provided in the side wall of the comminution chamber 3 via which the dry ice granules may be introduced. The dry ice granules are introduced via the aperture 10*a* in the event that soft particles 2 such as rubber or polymers are to be comminuted by means of the apparatus. By introducing the dry ice granules through the aperture 10*a* on the one hand and the particles to be comminuted through the aperture 10 on the other hand, both components are efficiently and thoroughly mixed. Thorough mixing is further promoted by the particle flow in the interior of the apparatus 1 during the comminution process. By adding the dry ice granules, the particles 2 to be comminuted are embrittled so that they may subsequently be comminuted.

The dry ice granules are introduced into the aperture 10*a* by way of a dosing unit, not shown, so that the amount of dry ice granules required for the embrittlement of the particles 2 may be set accurately.

In principle, the particles and the dry ice granules may also be introduced into the comminution chamber 3 via a joint aperture 10. Since the $CO_2$ escaping during the evaporation of the dry ice granules may present a safety risk for the operating personnel in the form of a risk of suffocation, the said apparatus as well as its inlets and outlets are sealed in a gas-tight manner. Moreover, in particular at locations of the apparatus 1 where an escape of gas may not be excluded entirely, gas warning devices, not shown, are provided, issuing alarm signals in the event of excessive $CO_2$ concentrations.

Two feed tubes 11, 11' exit at the bottom 9 of the comminution chamber 3. In their upper sections the feed tubes 11, 11' extend parallel to the sections of the tubes 8, 8' projecting beyond the comminution chamber 3. The feed tubes 11, 11' are curved at their lower ends and extend towards the tubes 8, 8'. One feed tube 11, 11' each terminates in one of the tubes 8, 8'. Due to this design of the tubes 8, 8' a portion of the particles 2 is fed from the comminution chamber 3 into the lower ends of the tubes 8, 8' via the feed tubes 11, 11' so that these form a plug 12 having a given filling level. In FIG. 1 such a plug 12 is located at the lower end of the right tube 8'.

A pressure pulse unit 13, 13', each comprising a valve 14, 14', follows on to each of the lower ends of the tubes 8, 8'. Via the pressure pulse unit 13, 13', the plug 12 at the lower end may be subjected to a pressure pulse at a given level and for a given period of time. In order to generate the pressure pulse, gas having a preset gas pressure is provided at the valve 14, 14'. The gas is preferably formed by air. Alternatively, an inert gas, a cryogenic gas or hot gas may be used. By the abrupt opening of a valve 14, 14', the gas flows explosively into the tube 8, 8' situated there above, propelling the plug 12 through the tube 8, 8' to hit the baffle 6. The level of the pressure pulse is typically in the range between 5 bar and 10 bar. By way of such pressure pulses trajectory velocities of the plug 12 in the range of between 70 m/s and 100 m/s are attained.

In the embodiment shown in FIG. 1 the valve 14' of the pressure pulse unit 13' following on to the right tube 8', is closed so that the plug 12 lies in its inert position at the bottom 9 of the tube 8'.

The plug 12 in the left tube 8 is propelled upwardly by opening the valve 14 of the corresponding pressure pulse unit 13. Here FIG. 1 shows a view at the instant at which the plug 12 is located at the upper end of the tube 8 not far ahead of the exit aperture.

After exiting from the respective tube 8, 8', the plug 12 hits the baffle 6, the direction of travel extending normal to the surface of the baffle 6 in the present embodiment.

It is of essence that the duration of the pressure pulse is selected shorter than the running time of the plug 12 in the respective tube 8, 8'. The plug 12 is thus no longer subjected to the pressure pulse on the travel path between the exit aperture of the tube 8, 8' and the baffle 6. As a result, an undesirable fanning out of the particles 2 prior to impacting of the particles 2 on the baffle 6 is avoided so that the shape of the plug 12 is maintained at least approximately until the particles 2 hit the baffle 6. As the particles 2 thus hit the baffle 6 in compact form, the recoil exerted by the baffle 6 propagates through all particles 2 of the plug 12 so that an efficient and complete comminution of the particles 2 is attained by virtue of the shearing forces acting on the particles.

In the event that dry ice granules are added to the particles 2 for their embrittlement, the dry ice granules promote the comminution process due to their sharp-angled crystalline structure. The dry ice granules have abrasive characteristics and cut through the particles 2 in their vicinity by way of their sharp-edged structures.

As is apparent from FIG. 1, no apertures 7 are provided in the surface of the baffle 6 on which the particles 2 impact so that no particles 2 are propelled directly through the apertures 7 into the collection chamber 4.

FIG. 1 schematically shows the particles 2 reflected and comminuted by the baffle 6, the said particles forming a cloud of dust 15. Due to the pressure pulse an excess pressure prevails at the front end of the baffle 6 so that the comminuted particles 2 are transported through the apertures 7 into the collection chamber 4. In the process only the particles 2 up to a given particle size are transported through the apertures 7 and are collected in the collection chamber 4 located downstream thereof while larger particles 2, due to their greater weight, drop back into the interior of the comminution chamber 3 and are fed afresh to the tubes 8, 8' in order to form further plugs 12. Typically, particles 2 having a particle size of about 10 mm when fed are comminuted by the apparatus according to the invention to a target particle size of about 1 μm.

By suitably dimensioning the diameter of the tubes 8, 8', the number and sizes of the apertures 7 of the baffle as well as the volume of the collection chamber 4, the particle sizes and particle size distributions of the comminuted particles 2 collected in the collection chamber 4 may be preset.

The number and sizes of the apertures 7 may be varied by exchanging different baffles 6 in a simple manner.

The size of the collection chamber 4 may also be varied in a particularly advantageous manner. For this purpose level-adjustable shaft compensators, gland boxes, sliding bushes or the like may be provided, which are not shown in the drawings. In this case, the greater the volume of the collection chamber 4, the better defined is the particle size distribution of the particles comminuted in the collection chamber 4.

A withdrawal aperture 16 is provided in the side wall of the collection chamber 4. The comminuted particles 2 may be withdrawn via this withdrawal aperture 16 at given times.

The pressure pulse units 13, 13' are controlled by a control unit, not shown, generating upon a preset time signal sequences of pressure pulses. The pressure pulse units 13, 13' are preferably controlled in an alternating manner so that a plug 12 is propelled alternatingly from the left or right tube 8 or 8' to hit the baffle 6. The cycles within which the tubes 8, 8' are charged with the individual plugs 12, are in the region of seconds or even milliseconds so that the timing rate of the pressure pulse may be selected correspondingly high. In this manner the individual plugs 12 are propelled in rapid succession to hit the baffle 6 so that a virtually continuous comminution process and a correspondingly high throughput may be attained by means of the apparatus 1 according to the invention.

After a plug 12 has been propelled from one of the tubes 8, 8', the corresponding tube 8, 8' is recharged with particles 2 via the respective feed tube 11, 11' in order to form a new plug 12. It is advantageous in this context that due to the impact occurring when propelling a plug 12, the particles 2 in the comminution chamber 3 are shaken and are thus fed to the feed tube 11, 11' at an increased rate, promoting the recharging of the tube 8, 8' with a plug 12. This charging function is further reinforced by the excess pressure prevailing in the upper region of the comminution chamber 3 when the plug hits the baffle 6.

The apparatus 1 according to the invention makes it possible to efficiently comminute, in particular, hard materials having Mohs' hardness scales preferably in the range between 7 and 10.

Figure 2:
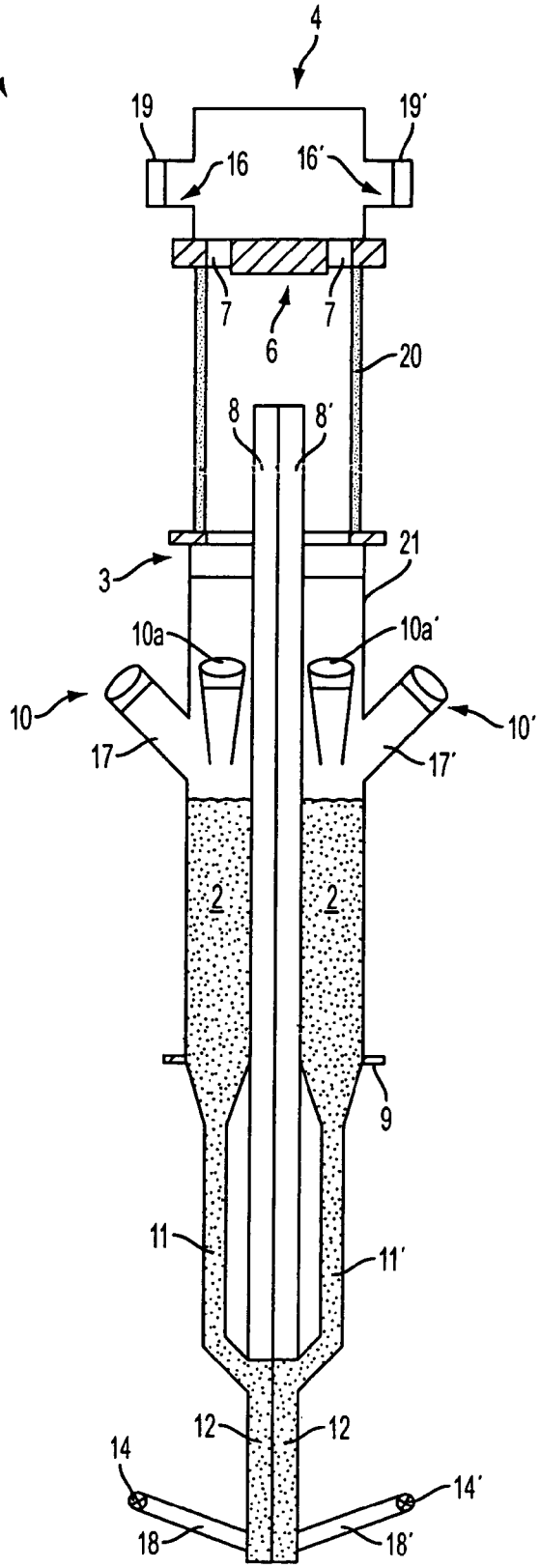
FIG. 2: a longitudinal section through a second embodiment of the apparatus according to the invention.

FIG. 2 shows a second embodiment of the apparatus 1 according to the invention. The apparatus 1 shown there corresponds structurally almost entirely to the embodiment according to FIG. 1.

In contrast to the embodiment according to FIG. 1, the apparatus 1 according to FIG. 2 comprises two apertures 10, 10' in the side wall of the comminution chamber 3, from which filling nozzles 17, 17' exit for charging the interior of the comminution chamber 3 with particles 2.

Furthermore, analogously to the embodiment according to FIG. 1 further apertures 10*a*, 10*a'* are provided for introducing dry ice granules.

A further difference resides in the fact that at the lower ends of the tubes 8, 8', where in each case the plugs 12 are situated, feeding nozzles 18, 18' exit, which extend towards the tubes 8, 8' in an inclined manner. In these feeding nozzles 18, 18' the valves 14, 14' of the pressure pulse units 13, 13' are arranged, which are not shown separately.

The longitudinal axes of the feeding tubes 8, 8' may extend in a horizontal plane, normal to the longitudinal axis of the apparatus 1 or, as shown in FIG. 2, they may extend inclined in relation to the plane at an angle of inclination, preferably not exceeding 20°.

Finally, the collection chamber 4 comprises two mutually opposite withdrawal apertures 16, 16', a nozzle 19, 19' exiting from each of the withdrawal apertures 16 or 16'.

Finally, a difference from the embodiment according to FIG. 1 resides in that the comminution chamber 3 comprises an upper portion 20, the cross-section of which is slightly smaller than the cross-section of the lower portion 21 of the comminution chamber 3. In principle, the upper and the lower portions 20, 21 may also be designed to consist of two parts. At the adjoining, open ends of the upper portion 20 of the comminution chamber 3 and the collection chamber 4 the baffle 6 is again fitted in a removable manner so that the latter may be exchanged if required.

The invention claimed is:

1. An apparatus for comminuting particles, comprising:

at least one tube including an exit aperture, the at least one tube for collecting a predetermined quantity of particles to form a plug in the tube;

at least one pressure pulse unit for generating a pressure pulse of predetermined intensity and length;

a baffle located downstream of the tube, the baffle including apertures; and a collection chamber following on to the baffle;

wherein the plug, after being subjected to the pressure pulse, is propelled through the exit aperture of the at least one tube to impact the baffle in which particles forming the plug are comminuted by the impact against the baffle and pass through at least one of the apertures of the baffle to the collection chamber, and wherein the collection chamber and the comminution chamber at their open ends facing one another each comprises an annular flange, the baffle being fitted between the annular flanges.

2. The apparatus according to claim 1, wherein at least one section of the tube is arranged in the interior of a comminution chamber, the open upper side of which is followed by the baffle, onto which the collection chamber is fitted.

3. The apparatus according to claim 2, wherein the collection chamber and the comminution chamber are each of hollow cylindrical design, the hollow cylinders having identical diameters and being arranged in a coaxial manner.

4. The apparatus according to claim 2, wherein the tube extends in the direction of the vertically extending longitudinal axis of the comminution chamber, the exit aperture at the upper end of the tube being opposite the baffle in a preset spaced apart relationship.

5. The apparatus according to claim 4, wherein a plurality of parallel extending tubes are provided.

6. The apparatus according to claim 1, wherein different baffles having different apertures are fittable between the annular flanges.

7. The apparatus according to claim 6, wherein the apertures are designed in the form of angular or round bores and/or in the form of annular slots.

8. The apparatus according to claim 1, wherein the volume in the interior of the collection chamber is adjustable.

9. The apparatus according to claim 8, wherein for adjusting the volume of the collection chamber at least one shaft compensator, one gland box or a sliding sleeve is provided.

10. The apparatus according to claim 1, wherein the collection chamber comprises at least one withdrawal aperture for withdrawing the comminuted particles.

11. The apparatus according to claim 1, wherein into the or into each tube a preset quantity of particles may be introduced for forming the plug in a preset spaced apart relationship in relation to the exit aperture and that below the region of the tube for accommodating the plug a connection is provided for the at least one pressure pulse unit.

12. The apparatus according to claim 11, wherein the pressure pulse unit comprises a valve, by way of which the plug may be subjected to pressurized gas.

13. The apparatus according to claim 12, wherein the gas is formed by air, an inert gas, cryogenic gas or hot gas.

14. The apparatus according to claim 12, wherein the gas is cooled and/or that the wall of the comminution chamber is jacketed by a cooling jacket.

15. The apparatus according to claim 11, wherein the section of the tube for accommodating the plug is located in the lower section of the tube, projecting beyond an underside of a comminution chamber.

16. The apparatus according to claim 15, wherein from the underside of the comminution chamber at least one feed tube exits, which terminates in the lower section of the tube projecting beyond the comminution chamber so that particles may be fed from the comminution chamber to the tube via the feed tube in order to form the plug.

17. The apparatus according to claim 16, wherein apertures are provided in the side wall of the comminution chamber for filling its interior with non-comminuted particles.

18. The apparatus according to claim 1, wherein means for feeding dry ice granules are provided.

19. The apparatus according to claim 18, wherein apertures are provided in the side wall of the comminution chamber for filling its interior with dry ice granules.

20. The apparatus according to claim 19, wherein the dry ice granules may be fed to the comminution chamber by way of a dosing unit.

21. The apparatus according to claim 18, wherein the apparatus is sealed in a gas-tight manner.

* * * * *